US006546967B2

(12) United States Patent
Lindblom

(10) Patent No.: US 6,546,967 B2
(45) Date of Patent: Apr. 15, 2003

(54) METHOD AND ARRANGEMENT FOR THE LINEAR MEASUREMENT AND MAGAZINE STORAGE OF THREAD IN LOOMS OR TEXTILE MACHINES

(75) Inventor: Bo Lindblom, Osby (SE)

(73) Assignee: Texo AB, Almhult (SE)

( * ) Notice: Subject to any disclaimer, the term of this patent is extended or adjusted under 35 U.S.C. 154(b) by 50 days.

(21) Appl. No.: 10/076,271

(22) Filed: Feb. 19, 2002

(65) Prior Publication Data

US 2002/0112773 A1 Aug. 22, 2002

(30) Foreign Application Priority Data

Feb. 16, 2001 (SE) ..... 0100509

(51) Int. Cl.[7] ..... D03D 47/34
(52) U.S. Cl. ..... 139/450; 139/452
(58) Field of Search ..... 139/452, 450

(56) References Cited

U.S. PATENT DOCUMENTS 4,114,658 A * 9/1978 Trubin et al. ..... 139/452
5,983,954 A * 11/1999 Hasegawa ..... 139/450
6,176,272 B1 * 1/2001 Wahhoud et al. ..... 139/435.5

* cited by examiner

*Primary Examiner*—John J. Calvert
*Assistant Examiner*—Robert H. Muromoto, Jr.
(74) *Attorney, Agent, or Firm*—Connolly Bove Lodge & Hutz, LLP; Larry J. Hume

(57) ABSTRACT

In an arrangement for the linear measurement and magazine storage of thread (7) ahead of the pick in looms or textile machines (18) use is made of thread feed elements (1) and thread length-measuring elements (2) together with magazines (6) designed to store a predetermined length of thread ahead of the pick in the machine. Elements (5, 5') reversing parts of the thread are designed to bring about interaction with thread parts between the thread support elements. The reversing elements are designed, during said interaction, to displace thread parts in directions that deviate from the feed direction into the magazine or magazines to a position or positions therein. The reversing elements are designed, after the introduction of read parts into the magazines, to return to their starting positions or home positions. The magazines are designed with devices, which retain parts of the thread in said positions. In this way an effective magazine storage and linear measurement function is obtained, especially for flat thread, which is prevented from twisting or tangling during said functions.

21 Claims, 4 Drawing Sheets

Snitt A - A

METHOD AND ARRANGEMENT FOR THE LINEAR MEASUREMENT AND MAGAZINE STORAGE OF THREAD IN LOOMS OR TEXTILE MACHINES

The present invention relates, among other things, to a method in looms or textile machines for the linear measurement and magazine storage of thread, which is fed out in a feed direction over thread support elements situated at an interval from one another, that is to say the bread support elements form a feed path. The invention also relates to an arrangement for the linear measurement and magazine storage of thread ahead of the pick in looms or textile machines and comprising thread feed elements and thread length measuring elements together with magazines designed to store a predetermined quantity of tread (quantity of thread or yarn) ahead of the pick in the machine.

Various types of magazine and feed wheel mechanism constructions are already known in the loom and textile machine sector. The function of the magazine is to store a quantity of thread that is to be used up in a pick or in a thread transfer function in the machine. The respective quantity of thread may be stored according to each pick and there is therefore a requirement that the quantity of thread be correct, for which reason length measuring functions also form part of the known arrangements. General reference is made to the patent literature in connection with this.

In the case of flat thread, for example, there is a need to be able to produce accumulated stocks in the magazine without the risk of the thread twisting or tangling during magazine storage or drawing out. This may also apply to other types of thread, for which reason the present invention addresses itself quite generally to various types of thread, but especially to flat thread, the stated problem of which, among other tings, the new magazine storage and measuring function is intended to solve.

It is also desirable, in associated types of looms and textile machines, to be able to arrange magazine functions so that high pick speeds of 60 picks per minute, for example, are achieved, and so that a number of pickers, for example 6 pickers, can be used in a number of magazines, which altogether can give draw-out times per thread of 6 sec. per thread, for example. If the pick takes 0.6 sec. for example, this gives 5.4 sec./thread, etc. It must be possible to optimize machine lengths, for example machine lengths of 15 meters, bobbin sizes, run times, total times, etc. effectively. The invention is also intended to solve these problems.

The components involved must be tried and tested and yet technically simple components. It must be possible to apply thread tension-measuring functions and use the feedback function so as to give good or outstanding results when weaving or the like. The invention is also intended to solve these problems.

A method according to the invention is therefore essentially characterized in that feed elements and length-measuring elements are activated and that reversing elements for parts of the thread situated between the thread support elements are actuated by means of actuators. Reversed thread runs ale then introduced into the magazine into the introduction position in the magazine by means of the reversing elements and the reversing elements are returned by means of the actuator once the reversed parts of the thread run have reached said introduction positions in the magazine. When returning the reversing elements to their home positions or starting positions, the parts of the thread introduced into the magazine are retained in said introduction positions by means of retaining devices. The magazine is thus loaded and ready for a relevant pick, in which the stored quantity of thread is drawn out against the action of the retaining device, which must therefore have a function which permits said drawing function.

In one embodiment a pulse generator is used in the length-measuring function. The pulse generator emits pulses, which actuate an alternating current motor in the feed element. In one embodiment a motor in the actuator may be controlled in order to instantaneously reverse/draw or introduce the thread parts into the magazine. After a number of pulses, dependent upon the feed length, from the pulse generator, the alternating current motor is then stopped. Speed-controlled, the motor of the actuator is brought to the home positions or starting positions. After drawing out of the measured length of stored thread, the thread tension is read off by means of a load cell. The number of pulses in the pulse generator is adjusted by comparing the registered actual value on the load cell and the set value used when drawing out. The alternating current motor can be acted upon so that it retracts any excess thread following the pick in the textile machine or loom.

An arrangement according to the invention is essentially characterized by a thread supporting track with thread support elements designed to receive thread drawn out in a drawing direction and by elements reversing parts of the thread, which are designed to bring about interaction with parts of the thread between the thread support elements. The reversing elements are furthermore designed, in said interaction, to displace parts of the thread in directions that deviate from the drawing direction into positions in the magazines. The invention is further characterized in that the reversing elements are designed, after the introduction of parts of the thread into the magazines, to return to the stag positions, and that the magazines are designed with devices that retain said parts of the thread in said positions.

In further developments of the idea of the invention, the length-measuring elements comprise a pulse generator arranged or suspended in a load cell and designed to control the thread-measuring element in the form of an alternating current motor by means of its pulses. The actuator actuates the reversing elements and the relevant actuator may thereby comprise a motor, such as an electric motor, for example, which acts upon the reversing element by way of transmission elements, comprising a toothed belt, for example. The actuator can thereby produce coordinated movement or a common movement of all reversing elements. The pulse generator may be adjustable by means of the registered actual value or the set value used. This provides a thread-measuring function, which in itself has an influence on the quantity of yarn. The thread may accordingly take the form of a flat thread and the thread support elements may consist of wheels or rollers, like the reversing elements. In one embodiment the magazines comprise elongate members, which extend in said directions that deviate from said feed direction. Said members may in principle be stirrup-shaped, the openings of the stirrups extending in the feed direction. Reversing elements are displaceably arranged along the (outer) edges of the members. Displacement into the positions in the magazine is designed to occur with the thread or the parts of the thread lying between the reversing elements and said member edges. Said devices may comprise brush or burr-like elements or devices which have a retaining function when the reversing elements return to the original or starting positions, but a yielding function when drawing out the thread from the magazine. The feed element can also be designed to retract any excess part of the thread after the pick. The quantity of thread stored by the magazine can thus be determined by means of the lengths of the thread parts drawn down into the magazine. For example, by selecting different magazine positions it is possible to store different quantities of thread in the magazine. These proposed means permit the use of advantageous dimensions for the bobbin which can be designed, for example, with a weight of 10 kg, an outside diameter of approx. 350 mm, an inside diameter of approx. 180 mm, and a length of approx. 250 mm. A conventional pulse generator and a conventional load cell can be used. Likewise conventional wheel or roller functions may be incorporated and in a preferred embodiment the reversing wheels or the reversing rollers can be coupled to toothed belts or drive motors for this purpose. The magazines may consist of a desired number of elements. The bobbin can be driven by a conventional alternating current motor and the pulse generator may be of the type that measures the length and adjusts the bobbin motor in a manner known in the art. The function is advantageous in that the bobbin motor winds out the weft thread and the motor that acts upon the reversing elements instantaneously draws in order to fill up the magazine. When the pulse generator has measured the predetermined length, the feed motor is stopped and the motor that controls the reversing elements can return, speed-controlled, to the home position. The weft thread can easily be retained when the reversing elements are returning, but at the same time allows the thread to be drawn out of the magazine. The load cell can be read off when the magazine is emptied of stored thread the actual value being compared with the set value and the difference adjusted by more or fewer pulses for the next weft. The thread tension can thereby be measured on a current pick and measured at 200 grams, for example. If a reduced thread tension is required, for example 150 grams, the thread length is increased by means of the load cell and pulse generator functions, so that a longer thread is obtained on the next pick (that is to say the arrangement introduces more thread into the magazine). If the thread length on the first pick is worked out to be 2 meters, for example, the thread length on the subsequent pick can be set, for example, to 12 meters and 5 centimeters, and so on. Corresponding functions exist where increased thread tension or reduced thread length are required.

DESCRIPTION OF FIGURES

A currently proposed embodiment of a method and an arrangement having the characteristic features of the invention will be described below, making reference to the attached drawings, in which FIG. 1 simplified (for the sake of clarity), shows a side view of the linear measurement and magazine storage arrangement for thread that can be drawn off from a bobbin.

Figure 1:
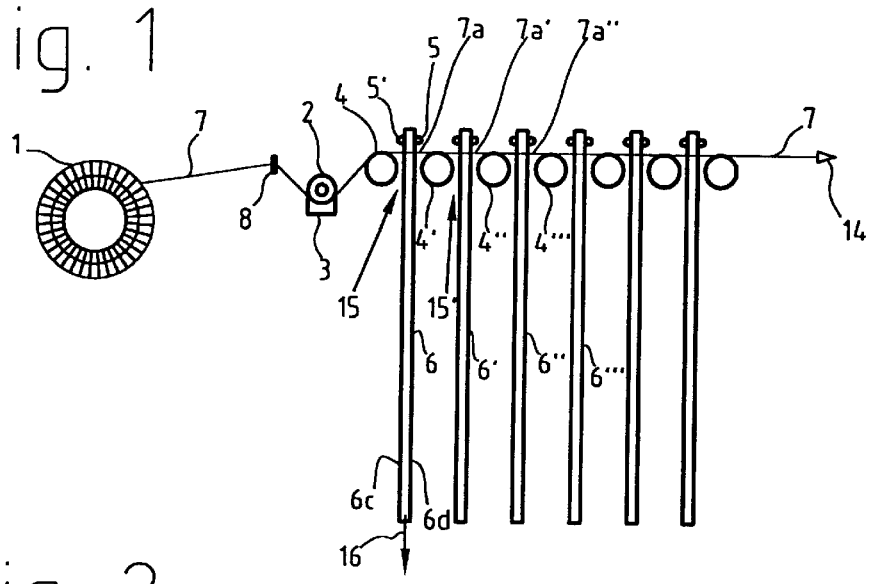

In the figures, 1 denotes a thread bobbin of the type specified above. 2 represents a pulse generator and 3 is a load cell. 4 indicates one wheel of a number of wheels arranged at intervals from one another in the drawing direction of the thread in question. 6 is intended to illustrate a magazine, whilst 7 represents the weft thread for a weaving process not shown in the figures. 8 represents a guide eye. 9 is intended to represent a linear guide, 10 a toothed belt and 11 a motor described in more detail below. Also included are a control unit 12 and an alternating current motor 13 for driving the bobbin 1.

FIG. 1, among others, shows how the thread 7 is wrapped around or partially runs around the pulse generator 2, which measures the relevant length. From the pulse generator the thread is fed out over the thread path that is formed by a number of thread support elements 4, 4', 4", 4'", etc., which according to the above take the form of wheels, which permit said drawing out of the thread. The feed direction of the thread is indicated by 14. As an alternative to the wheels, 4 may consist of rollers or elements with a low coefficient of friction for the thread.

The magazine or elongate members forming the magazines are indicated in the figures by 6, 6', 6", 6'", etc. The number of elongate members can be varied according to the quantities of yarn that it is proposed to store for each draw. Similarly, tie length(s) of the members can be varied. As will be seen from FIG. 4, each elongate member is formed as a stirrup having two legs 6*a*, 6*b*, which extend in an upright direction. Each elongate member thus has two side edges 6*c*, 6*d* and the stirrup gap thus extends so that the thread 7 can run into the intermediate space 6*e* (see FIG. 4) between the stirrup parts. The gaps 6*e* thus extend in the drawing direction. Each elongate member interacts or is arranged in or with pairs of reversing elements, a pair of reversing elements being indicated in FIG. 1 by 5, 5'. Said pairs of reversing elements are displaceable along said edges 6*c*, 6*d* of each element 6. This displacement of the reversing elements 5, 5' is described in more detail below. In a preferred exemplary embodiment the elements 5, 5' consist of wheels, but may also consist of rollers, or elements having a low coefficient of friction. Said elements are situated in the spaces 15, 15', etc. between the support elements 4, 4', 4", 4'", etc. In the drawing-out stage shown in FIG. 1, parts of the thread, which are indicated by 7*a*, 7*a'*, 7*a"* in FIG. 1, are situated between the support elements. The members extend in directions 16 that deviate from the feed direction 14. In the case shown in FIG. 1, the angle between the direction 16 and the drawing direction 14 is approx. 90°. However, the invention works for angles other than 90°. In the exemplary embodiment shown in FIG. 1, the pair of wheels 5, 5' is displaceable in relation to the member 6, which is fixed in a vertical direction. Alternatively, the element 6 may also be displaceable and the pair of wheels 5, 5' may be more or less stationary. In the event of a relative displacement between the pair of wheels 5, 5' and the element 6, the pair of wheels comes into interaction with th thread parts 7*a*, 7*a'*, 7*a"*, etc., and presses the relevant part of the thread in the direction 16, which thus differs from the direction 14. Corresponding functions exist for other pairs of reversing elements and the corresponding or located parts of the thread. This displacement means that the parts of the thread are pressed down in the direction 16 into the members 6, 6', 6", 6'", etc., which thereby individually form a partial magazine and together form a whole magazine. This depression or pressing into the members 6, 6', 6", 6'", etc., can take place at the same time as the thread 7 is being fed out in the direction 14. The reversing elements 5, 5' therefore cause the parts of the tread to be reversed in the run. The parts of the thread are depressed and pressed in until the reversing elements 5, 5' have reached the desired or predetermined magazine position 17.

Figure 2:
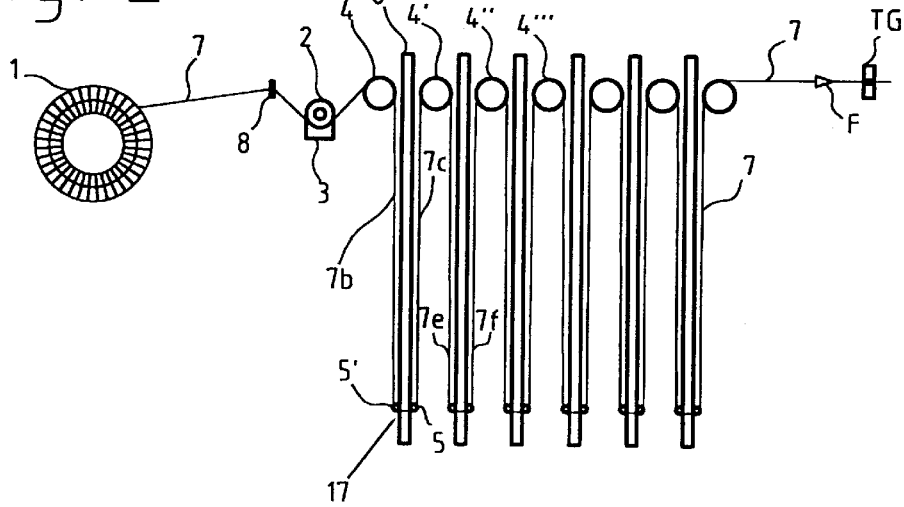
FIG. 2 shows a simplified side view of the arrangement according to FIG. 1, but at a second working stage, in which parts of the thread are introduced into positions in the magazines by reversing elements.

In FIG. 2, parts of the thread thus reversed are indicated by 7*b*, 7*c*, 7*e*, 7*f*. It will be appreciated therefore that a magazine function exists by virtue of the reversal of the thread run shown. The support elements or the wheels 4, 4', 4", 4'" are used as deflection wheels around which the relevant parts of the thread are guided. The parts of the thread are pressed into the magazine against the action of a force F, which is applied to the thread. This force may be generated, for example, by means of thread gripper elements, as shown symbolically by TG. The thread 7 is fed out while ever the actuator for the bobbin 1 is activated. See also below. In FIG. 2 the pair of reversing wheels 5, 5' have reached their relevant limit position and can return to their home positions or starting positions according to FIG. 1, in which the reversing elements are situated above the thread run. The function of drawing into the magazines or members 6 may in principle be performed once all the thread has been fed off the bobbin 1, or simultaneously or in coordination with the feed function from the bobbin.

Figure 3:
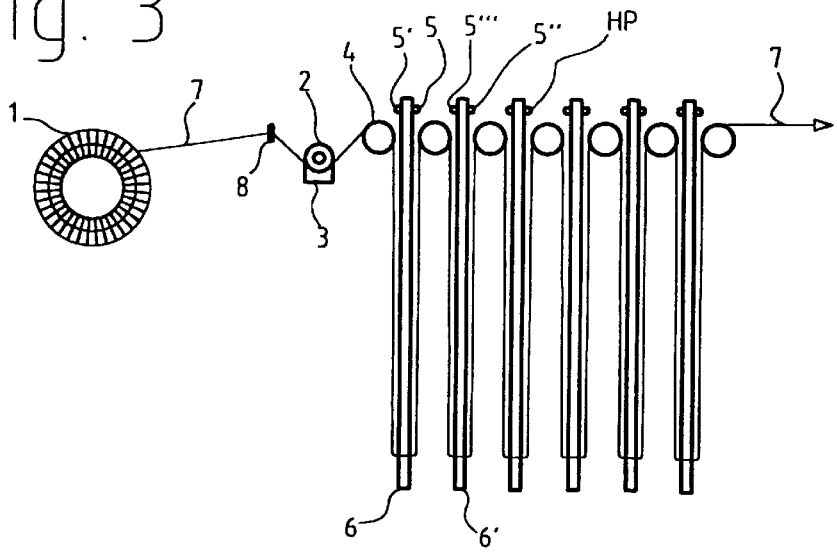
FIG. 3 shows a simplified side view of the arrangement according to FIGS. 1 and 2, but at a third stage, in which parts of the thread have been drawn down to their positions in the magazine in accordance with FIG. 2, but in which the reversing elements have been returned to their home positions.

FIG. 3 shows the stage in which the reversing elements 5, 5' have reached the home positions BP or starting positions. In FIG. 3 the reversing elements for the member 6' have been indicated by 5" and 5'", whilst other reversing elements have not been provided with any reference masks.

Figure 4:
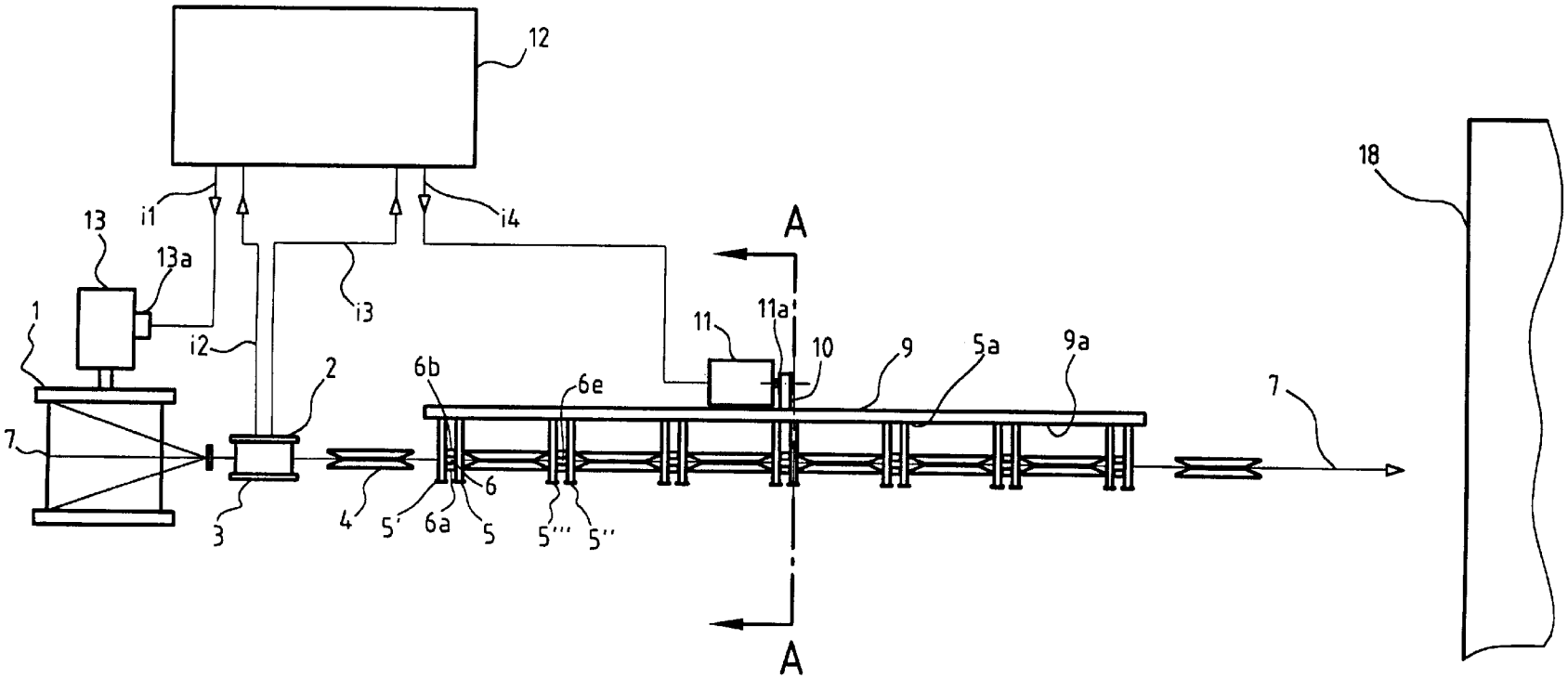
FIG. 4 shows a top view of the arrangement according to any of the FIGS. 1–3, FIGS. 5 and 5*a* along the section in FIG. 4, show actuators for the thread part reversing elements in two different working positions.

FIG. 4 shows how the reversing elements 5, 5', 5", 5'", etc. are connected together by the linear guide 9, to which all reversing elements are thus connected by their first ends 5*a*. Each reversing element or wheel is thus pivoted in the linear guide 9 or the guide rail by way of or at their inner side 9*a*. This bearing can be constructed in a manner known in the art so that the wheel rotation function is achieved. In an exemplary embodiment a ball bearing or bearings (not shown) is/are used to facilitate the rotation. The unit 12 may consist of or form part of the control unit for the loom or textile machine in question, as symbolized by the number 18 in the figure. The loom or textile machine may be of types known in the art, and may consist, for example, of looms that are available on the general market from TEXO AB/SE. Since the machines themselves may be already well-known they will not be described in any further detail here. By means of first signals or pulses i1, said unit 12 controls the alternating current motor 13, which is provided with a unit 13*a*, which in a manner known in the art converts the relevant sequence of pulses or control signals for electrical control of the alternating current motor 13. The pulse generator 2 is designed to emit a certain number of pulses i2 as a function of its rotation, which is in turn dependent on the rate at which the thread 7 is drawn out. The pulse generator is thus capable of converting the drawn length into a number of pulses i2, by means of which the pulse generator controls the alternating current motor 13 either directly or (as in FIG. 4) by way of the unit 12. When the generator has counted out a certain number of pulses, the alternating current motor 13 must be stopped, that is to say continuous feeding from the bobbin must cease. The load cell 3 sends electrical signals i3 to the unit 12 concerning the relevant thread tension. The feed function for the thread 7 may be varied in a manner known in the art, so that the actual value from the cell 3 is compared with the set value. In this way the number of pulses or the electrical signal i1 can be adjusted and the feed function also adapted to the thread tension or the elasticity of the thread. The unit 12 also controls the motor 11, which must instantaneously draw the reversing elements 5, 5', 5", 5'":, etc. down into the above-mentioned magazine positions (cf. 17 in FIG. 2). This guiding is symbolized in the figure by i4. The linear guide 9 acts upon the motor 11 by means of the transmission elements 10, which in one embodiment may consist of a toothed belt of a type known in the art, which is supported about the drive wheel 11*a* of the motor 11.

Figure 5:
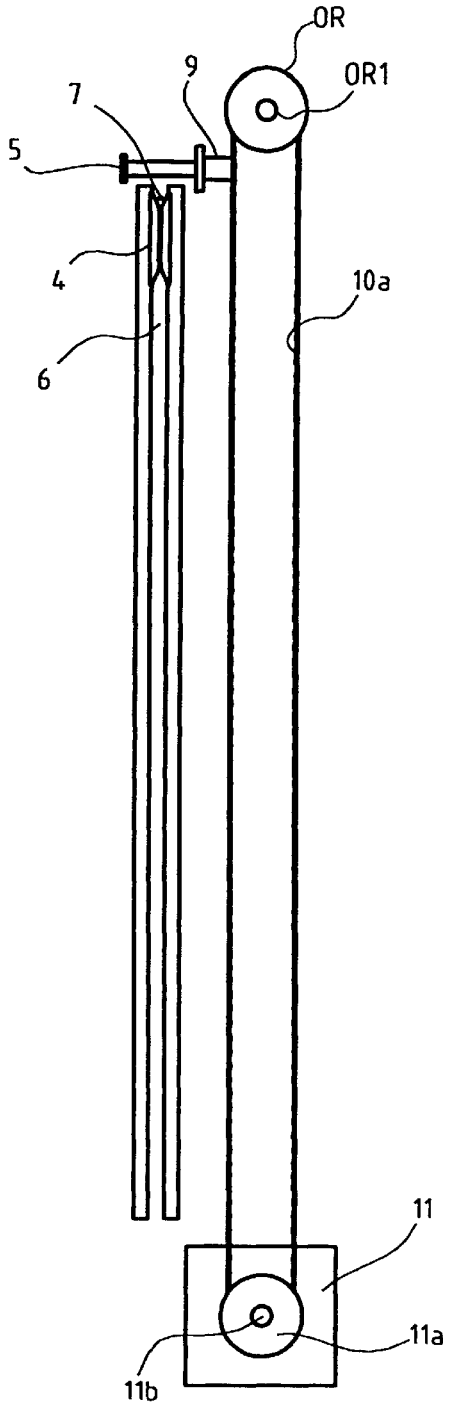
Figure 5A:
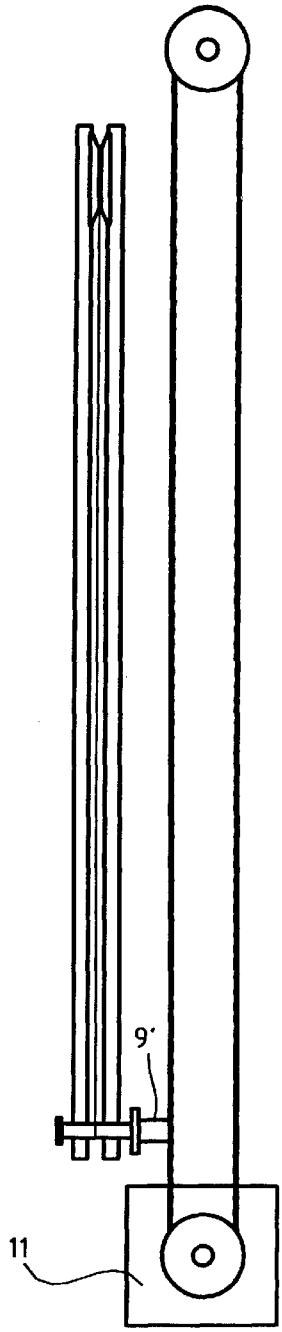

FIGS. 5 and 5*a* show how the drive belt 10 is supported around the drive sheave 11*a* of the electric motor 11 the sheave being fixed to the shaft 11*b*. The drive belt is also supported around an element OR, which may consist of a rotatable wheel, arranged on a fixed shaft OR1. The wheels/sheaves OR/11*a* have interacting surfaces, which interact with teeth 10*a* of the belt for positive or non-slip driving of the belt, which is not actuated relative to the sheaves or the wheels. Arranged on the outside of the belt is said rail 9, in which the above-mentioned pairs of wheels are rotatably fixed. FIGS. 5 and 5*a* show corresponding positions for the reversing elements according to FIGS. 1 and 2. In FIG. 5*a* the lower position of the rail has been shown by 9'.

Figure 6:
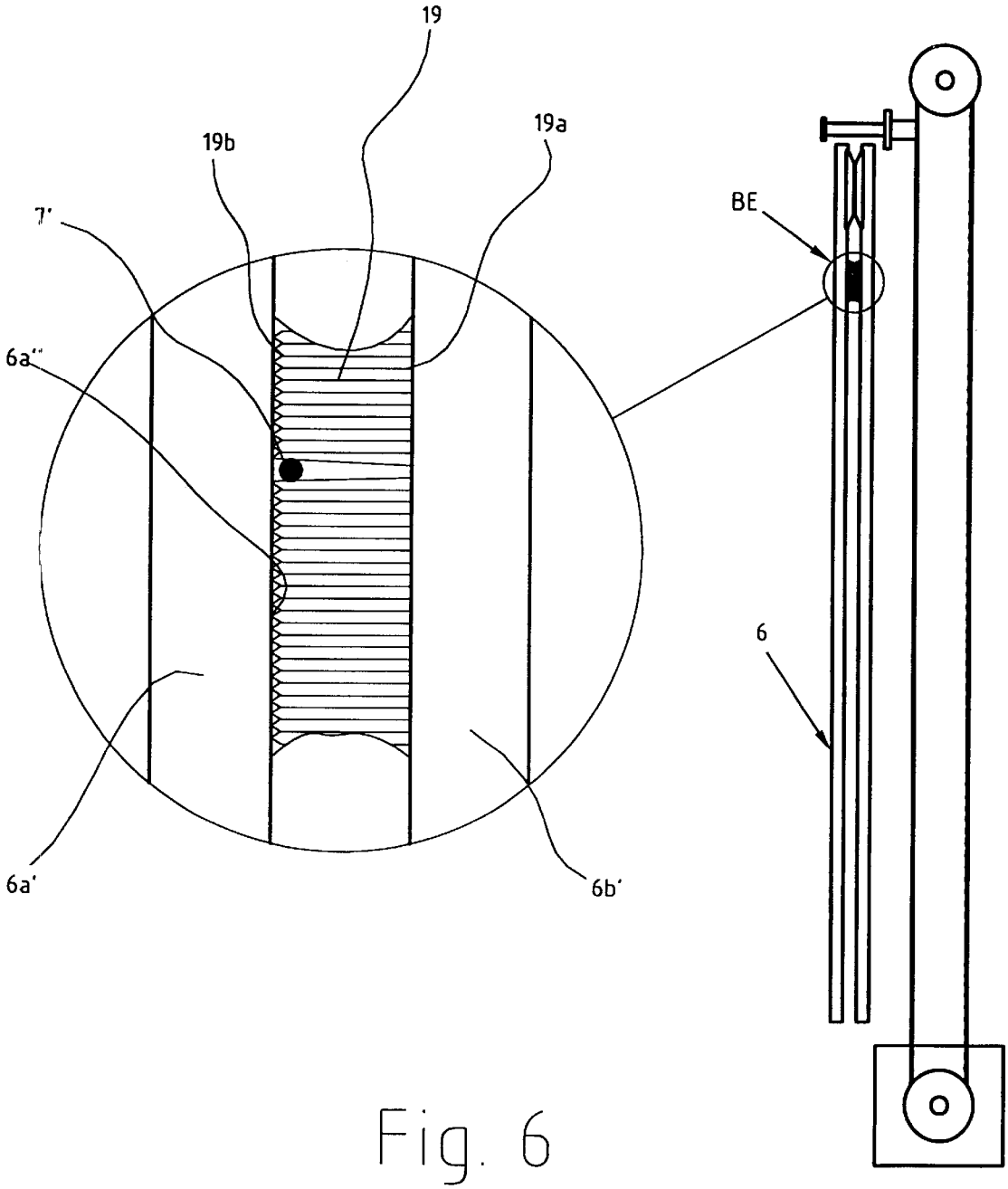
FIG. 6 shows an enlarged cross-section of that part of the thread held in a magazine position by means of a brush or burr function.

FIG. 6 is fundamentally intended to show the retaining or holding function for part of the thread in the magazine position attained according to the above. The holding device in this consists of the burr or brush function 19. This retaining function allows the part of the thread to be held in the magazine position when the reversing elements are moved into the relevant starting position(s). In addition, the retaining function permits the drawing function from the magazine for the thread 7. Alternatively, mechanical locks can be arranged for the part or parts of the thread in question. In the exemplary embodiment according to FIG. 6, use is made of a brush mat 19*a* fixed in a member part for example the member part 6*b*'. The brush bristles or the brush elements 19*b* are directed toward the other member part 6*a*. The thread part is guided downward in relation to the free ends of the brush members when introduced into the magazine and upward when it is drawn out of the magazine. The above-mentioned retaining function is achieved by the friction between the thread part 7*a*, the inner surface 6*a*" of the member 6*a*' and the brush members. The brush mat or the members may extend along the entire inside surfaces of the members 6*a*' and 6*b*' or parts thereof. The brush members may therefore extend from the middle parts of the magazine members 6, downward to closed or fill feed positions of the thread part 7'.

The reversing elements may be controlled individually and the magazine positions in the various members may be varied, with the aim of achieving the facility for varying the quantity of thread in the overall magazine function. In the case shown, it has been proposed fiat the feed function be performed by means of pulse control from the pulse generator 2. Alternatively, the feed function may be controlled as part of the control function for the alternating current motor 13 or the like. Other types of motors may be used, such as motors that work hydraulically and/or pneumatically, for example.

The invention is not confined to the embodiment shown above by way of an example, but ends itself to modifications within the scope of the following claims and the idea of the invention.

What is claimed is:

1. A method for linear movement and magazine storage of thread fed out in a feed direction aver thread support elements situated at intervals from one another in a loom or textile machine, the method comprising:

activating feed and length-measuring elements;

actuating, via actuators, reversing elements for thread parts situated between the thread support elements;

introducing, via the reversing elements, reversed thread run parts into a corresponding introduction position in each of one or more magazines;

returning the reversing elements to an initial position by use of one or more of the actuators; and retaining, via retaining devices, the reversed thread run parts situated in the corresponding introduction positions.

2. The method of claim 1, further comprising:

adjusting one or more pulse generators in respective feed and length-measuring elements; and controlling an alternating currant motor in at least one of the feed and length-measuring elements, wherein said controlling is performed by pulses generated by the one or more pulse generators.

3. The method of claim 1, further comprising controlling an actuator motor to instantaneously draw thread parts into the one or more magazines;

stopping the alternating current motor after a number of pulses from the one or more pulse generators are generated, said number of pulses corresponding to a thread pan length measurement, and using speed control, returning the actuator motor to a starting position.

4. The method of claim 1, further comprising:

reading, after drawing out of a measured length of stored thread, a load cell registering a thread tension; and adjusting the number of pulses generated in the pulse generator by comparing the registered thread tension value on the load cell with a set value used fir the feed.

5. The method of claim 1, further comprising retracting, via use of the alternating current motor, any excess thread after a pick in the textile machine or loom.

6. An arrangement suitable for a linear measurement and magazine storage of predetermined length of thread or yarn ahead of a pick in a loom or textile machine, the arrangement comprising:

thread feed elements;

thread length-measuring elements, said Thread feed elements and thread length-measuring elements being arranged together with one or more magazines to store the predetermined length of thread or yarn ahead of said pick;

reversing elements which reverse parts of the thread and interact with thread parts between thread support elements, wherein the reversing elements displace the parts of the thread or yarn in directions that deviate from a feed direction into the one or more magazines to a corresponding one or more positions, wherein the reversing elements, after the introduction of thread or yarn parts into the one or more magazines, each return to an associated starting position, wherein the one or more magazines include devices which retain parts of the thread or yarn in said corresponding one or more positions.

7. The arrangement of claim 6, wherein the thread length-measuring elements comprise a pulse generator arranged in a load cell, wherein the thread feed elements are controlled by an alternating current motor, wherein the alternating current motor is controlled by pulses generated by the pulse generator.

8. The arrangement of claim 6, further comprising an actuator which actuates the reversing elements.

9. The arrangement of claim 6, further comprising:

an actuator including an electric motor, and transmission elements coupled to said electric motor, said actuator actuating the reversing elements via the transmission elements.

10. The arrangement of claim 6, further comprising an actuator which coordinates movements of the reversing elements.

11. The arrangement of claim 6, further comprising a pulse generator, said pulse generator being adjustable by an actual thread tension value registered on a load cell and a set thread tension value.

12. The arrangement of claim 6, wherein the tread or yarn comprises flat thread.

13. The arrangement of claim 6, wherein the thread support elements comprise either wheels or rollers.

14. The arrangement of claim 6, wherein the reversing elements comprise either wheels or rollers.

15. The arrangement of claim 6, wherein the one or more magazines comprises elongate members that extend in said directions that deviate from the feed direction, the reversing elements being displaceable along edges of the elongate members, wherein the displacement to said corresponding one or more positions in the one or more magazines occurs with the thread or yarn in intervening parts of the thread or yarn.

16. The arrangement of claim 6, wherein said devices comprise brush or burr-like elements which have a retaining function when the reversing elements are being returned to the associated starting positions, but a yielding function when drawing the thread or yarn out of the one or more magazines.

17. The arrangement of claim 6, wherein the thread feed elements refract a remaining part of the thread or yarn after to pick.

18. The arrangement of claim 6, wherein a quantity of thread or yarn stored in the one or more magazines is determined by a draw-down length in each of said one or more magazines.

19. The method of claim 2, further comprising:

controlling a motor in the actuator to instantaneously draw or introduce thread parts into the one or more magazines;

stopping the alternating current motor after receiving a number of pulses from the pulse generator, said number of pulses being dependent upon a length measurement; and returning the actuator motor, speed-controlled, to the starting position.

20. The method of claim 2, further comprising;

drawing out a measured length of stored tread;

reading a load cell registering a tread tension after said drawing out; and adjusting a number of pulses in the pulse generator by comparing the registered actual thread tension value on the load cell with a set tread tension value used for a feed operation.

21. The arrangement of claim 9, wherein the transmission elements include a toothed belt.

* * * * *